United States Patent [19]

Stayner

[11] 4,336,147

[45] Jun. 22, 1982

[54] BORATE-CONTAINING WATER-IN-OIL MICROEMULSION FLUID

[75] Inventor: Robert A. Stayner, Lafayette, Calif.

[73] Assignee: Chevron Research Company, San Francisco, Calif.

[21] Appl. No.: 132,920

[22] Filed: Mar. 24, 1980

[51] Int. Cl.[3] ..... C10M 1/06

[52] U.S. Cl. ..... 252/49.5

[58] Field of Search ..... 252/49.5

[56] References Cited

U.S. PATENT DOCUMENTS

| | | | |
|---|---|---|---|
| 1,246,869 | 11/1917 | Burch | 252/49.5 X |
| 2,430,400 | 11/1947 | Hoelscher | 252/49.5 |
| 2,958,659 | 11/1960 | Brown | 252/49.5 X |
| 3,071,543 | 1/1963 | McGee | 252/49.5 X |
| 3,117,930 | 1/1964 | Kukin et al. | 252/49.5 X |
| 3,169,923 | 2/1965 | Guarnaccio et al. | 252/32.5 |
| 3,313,727 | 4/1967 | Peeler | 252/25 X |
| 3,645,897 | 2/1972 | Gower et al. | 252/49.5 X |
| 3,801,504 | 2/1974 | Stone | 252/49.5 X |
| 3,997,454 | 12/1976 | Adams | 252/18 |
| 4,100,081 | 7/1978 | Dreher et al. | 252/515 A X |
| 4,138,348 | 2/1979 | Grasshoff | 252/49.5 X |

*Primary Examiner*—Andrew Metz

*Attorney, Agent, or Firm*—D. A. Newell; S. R. LaPaglia; J. J. DeYoung

[57] ABSTRACT

Disclosed is a water-in-oil emulsion fluid comprising 0.99 to 50 percent by mass water, 50 to 99 percent by mass oil, and 0.01 to 10 mass percent of an alkali metal borate.

4 Claims, No Drawings

BORATE-CONTAINING WATER-IN-OIL MICROEMULSION FLUID

FIELD OF THE INVENTION

The invention relates to an aqueous emulsion, more particularly a water-in-oil emulsion.

BACKGROUND OF THE INVENTION

Emulsions are two-phase systems consisting of two incompletely miscible liquids, one being dispersed as finite globules in the other. The dispersed, discontinuous, or internal phase is the liquid that is broken up into globules. The surrounding liquid is known as the continuous or external phase.

Aqueous based lubricants and functional fluids have been greatly in demand because of their low cost, but also because of their ease of disposal, reduced dependence on supply of petroleum-derived base fluid, and their fire resistance.

Alkali metal borates are well known in the oil-based lubricant and grease art for their extreme pressure properties. See for example, U.S. Pat. Nos. 4,100,081; 3,997,454; and 3,313,727. Dispersions of alkali metal borates, however, have not been previously used in water-in-oil emulsion fluids.

SUMMARY OF THE INVENTION

Disclosed is a water-in-oil emulsion comprising 0.99 to 50 percent by mass water, 50 to 99 percent by mass of oil, and 0.01 to 10 mass percent of an alkali metal borate.

DETAILED DESCRIPTION OF THE INVENTION

The emulsion of the present invention is useful as a functional fluid or aqueous-type lubricant particularly as a hydraulic fluid, die casting lubricant, stamping fluid, rust preventive coating, and in other similar applications.

The emulsion contains water, oil, borate and surfactant to prevent the separation of the components into various phases.

The water-in-oil emulsion of the present invention comprises from about 0.99 to 50, preferably 30 to 50 and more preferably 35 to 45 mass percent water, 0.30 to 99, preferably 35 to 70 and more preferably 50 to 60 mass percent oil; and 0.01 to 20, preferably 3 to 15, and more preferably 4 to 10 mass percent of an alkali metal borate.

Suitable oils include both natural and synthetic oil. Preferred are the mineral oils and fractions thereof. Particularly preferred are the lower viscosity mineral oils having viscosities ranging from about 10 CST (centistoke) at 40° C. to about 100 CST at 40° C. Also preferred are mineral oil fractions of naphthenic based stocks because of their ease of emulsification as compared to paraffinic based stocks which are more difficult to emulsify. Suitable synthetic oils include the diesters, alkyl benzenes, polyalphaolefins, and the like.

The alkali metal borates useful in the emulsion fluids of the present invention are well known in the art and are available commercially. See, for example, U.S. Pat. Nos. 3,313,727; 3,565,802; and 3,833,772, the entire disclosures of which are incorporated herein by reference. The hydrated alkali metal borates can be represented as having the following empirical formula.

$$M_2O.xB_2O_3.yH_2O$$

where M is an alkali metal of atomic number in the range 11 to 19, i.e., sodium and potassium, x is a number of from 0.25 to 4.5; preferably 2.5 to 3.5, (both whole and fractional) and y is a number up to 5 (both whole and fractional). This formula is intended to be empirical and not to define the exact form in which the borate exists in the emulsion of the present invention. The borate particle on the average is finely-divided and will generally have a mean particle size of less than one micron. Preferred are the hydrated potassium borates, particularly the hydrated potassium triborate microparticles having a boron-to-potassium ratio of about 2.5 to 4.5.

To form the emulsion and in order to prevent the separation of the emulsion into separate phases, the use of a surfactant or surface active agent is necessary. Suitable surfactants for forming water-in-oil emulsions are usually those having a low HLB (hydrophile-lipophile balance) value, typically in the range of 1 to 8 preferably 3–6. These surfactants include the anionic, nonionic, cationic and amphoteric surfactants which are well known in the art, see for example, Kirk-Othmer, Encyclopedia of Chemical Technology, Second Edition, Volume 19, pages 507–590, the entire disclosure of which is incorporated herein by reference.

The anionic surfactants include both acids and salts and are categorized as carboxylates, sulfates, sulfonates, and the phosphate esters. The carboxylates are aliphatic compounds having a carboxylic acid (COOH) group in the molecule. Among the useful carboxylates are the fatty acids, rosin, tall oil, and various naphthenic acids having from 8 to 30 carbon atoms.

The sulfate emulsifiers are mono-esters of sulfuric acid and an aliphatic alcohol. Preferably, the alkyl group has from 10 to 100 carbon atoms in essentially linear arrangement. Another class of sulfates are the mono-esters of sulfuric acid and an ethoxylated alcohol. In this class, the alkyl group is from 10 to 100 carbons in extent and the number of ethylene glycol units ranges from 1 to 10.

The sulfonate emulsifiers include both aliphatic and alkyl substituted aromatic sulfonates. Aliphatic sulfonates have from 10 to 100 carbon atoms in essentially linear arrangement with a sulfonic acid group ($SO_3H$) attached thereto. Preferably, this acid group is near the end of the carbon chain. The alkyl substituted aromatic sulfonates comprise a sulfonated benzene or naphthalene molecule having one or more alkyl groups to 1 to 30 carbon atoms each, attached to the aromatic ring. One convenient source of sulfonates is the sulfonation of aromatics contained in various petroleum fractions obtained in the refinery of crude oil.

The phosphate esters are mono- or di-esters of phosphoric acid and an alcohol. The total number of carbon atoms in the alkyl groups of these esters is in the range of 10 to 100.

In all of the above anionic surfactants the useful salts are alkaline earth metal salts, or the amine salts. The amine salts are formed from oil soluble polyamines such as tetraethylinepentamine, imidazolines and the like. Preferably, the salt is the calcium salt.

The nonionic surfactants do not ionize in solution and are compatible with either anionic or cationic surfactants. The simplest nonionics are alcohols, amides, and hydroxy alkyl esters having an essentially linear 10 to 30 carbon aliphatic backbone. Examples include cetyl alcohol, fatty acid alkanol amides, etc. However, the most common type of nonionic surfactant is that formed by ethoxylating an alcohol, an alkylphenol, as carboxylic acid, or carboxylic amide with ethylene oxide. In each of these cases, the hydrophilic portion of the surfactant is either $\beta$-hydroxy ethyl or a polyether of ethylene glycol. The hydrophilic portion is an alkyl or alkylaryl group of 10 to 100 carbon atoms. Another type of nonionic surfactant is that formed by the reaction of a polyethylene polyamine with a mono or dicarboxylic acid or anhydride to give amide or imide products. A preferred dicarboxylic anhydride is 2-alkenylsuccinic anhydride. In these nonionic surfactants, the hydrophilic portion of the molecule comprises a polyamine group having from 2 to 6 nitrogen atoms. The preferred amine is tetraethylenepentamine.

Another class of useful non-ionic surfactants are the sorbitol derivatives. These include mono- or polyesters with fatty acids of 10 to 100 carbon atoms.

The cationic surfactants are generally hydrochloride salts of tertiary amines or chloride salts of quaternary amines. These amines usually have one long carbon chain, and 2 or 3 short chains. The amines useful to form these cationic surfactants have from 10 to 100 carbon atoms, preferably with 8 to 98 of the carbon atoms in one alkyl group or one alkylsubstituted arylmethyl group.

Other types of useful cationic surfactants include the imidazolines, oxygen-containing amines and the like.

For the present invention, the preferred surfactants are the calcium sulfonates of alkylbenzene and succinimides produced by reacting polybutenyl succinic anhydride with tetraethylenepentamine.

The quantity of the surfactant necessary to form stable emulsion which will not separate into separate phases with prolonged storage may vary greatly with the type of surfactant. The surfactant will generally be oil-soluble and will generally comprise from 0.5 to 25 mass percent of the emulsion, preferably 1 to 10 percent, more preferably 2.0 to 5.0 percent.

The emulsion fluid may also contain additional additives, if desired, for the particular service contemplated. When used as a hydraulic fluid, a small amount of petroleum derived lubricating oil may be used. When lubricating oil is present in the formulation, an emulsifier and coupler, such as hexylene glycol, should also be present. Other additives that may be present in the emulsion of the present invention include antiwear agents, such as the zinc dithiophosphates, amine phosphates, and phosphate esters; rust inhibitors, corrosion inhibitors, metal deactivators, bactericides, and antifoam agents.

EXAMPLES

Drilling Torque Test

A water-in-oil emulsion fluid of the present invention was tested for its properties as a lubricant in the Drilling Torque Test. In this test a drill press with variable power feed and a variable speed is used. A drilling torque measuring system comprised of rotating work piece holder, a table, a torque arm, a strain gauge, a load cell, and a recorder is used. The drill bits are high speed steel, jobbers-length, $\frac{3}{8}$-inch diameter, with cutting edges preground to 130°. The drilling test material is AISI 304 stainless steel cut into blocks measuring 6 inches × 6 inches × $1\frac{1}{2}$ inch.

The torque measuring system is calibrated to zero as well as to the final stopping point of 110 inch-pounds of torque.

A precision ground drill is securely tightened in the drill press chuck. The drill feed rate is set at 0.006 inch per revolution. The drill press is adjusted for the desired rate of revolution and the oil pump is started. The drill is manually lowered until it is almost touching the test block. The automatic feed is then engaged and a hole is drilled. When the hole is complete, the drill bit is raised, the work block is rotated and a new hole is drilled. This procedure is continued at the constant selected rate of revolution until the drilling torque exceeds the limit of 110 inch-pounds or until 50 holes have been drilled with a single drill bit.

In another variation of this test, the initial hole is drilled at a speed of 450 rpm, and each additional hole at a 50 rpm increase in speed. When the torque exceeds 110 inch-pounds, the test is stopped and the speed in rpm's is recorded.

Test emulsion A comprised 50 mass percent water, 33.5 mass percent 100 pale oil and 16.5 mass percent of a borate-containing oil dispersion. The borate-oil dispersion in turn consisted of 25 mass percent 100 pale oil, 25 mass percent of a surfactant comprising a mixture of calcium sulfonate and polyisobutenyl succinimide produced by the reaction of polybutene (MW 1200) succinic anhydride with tetraethylenepentamine, and 50 mass percent of hydrated potassium triborate. This water-in-oil dispersion was prepared in accordance with the teaching of U.S. Pat. No. 3,997,454, the disclosure of which is incorporated herein by reference. The test results are shown in Table I.

TABLE I

| DRILLING TORQUE TEST | Composition A |
|---|---|
| RPM to Failure | 1300, 1400 |
| Holes at 800 RPM | 50+ |
| Holes at 1000 RPM | 27 |

What is claimed is:

1. A water-in-oil microemulsion fluid consisting essentially of:

(a) 30 to 50 percent by mass water;

(b) 35 to 70 percent by mass of a mineral oil; and (c) 3.0 to 15.0 percent by mass of a potassium borate having a boron-to-potassium metal ratio of 2.5 to 4.5.

2. The emulsion fluid of claim 1 wherein said fluid contains 0.5 to 25 percent by weight of a surfactant.

3. The emulsion fluid of claim 2 wherein said alkali metal borate is a potassium triborate.

4. The water-in-oil microemulsion fluid of claim 1 wherein:

(a) 35 to 45 mass percent of said fluid is water;

(b) 50 to 60 mass percent of said fluid is said mineral oil;

(c) 4.0 to 10.0 mass percent of said fluid is a potassium borate.

* * * * *